United States Patent [19]

Wyatt, Sr. et al.

[11] 4,315,487

[45] Feb. 16, 1982

[54] METHOD AND APPARATUS FOR MODIFYING THE IGNITION SYSTEM OF MULTI-CYLINDER ENGINES

[76] Inventors: James W. Wyatt, Sr., 916 Walker St., Wenatchee, Wash. 98801; James D. McEntire, 9025 11th SW., Seattle, Wash. 98106

[21] Appl. No.: 85,502

[22] Filed: Oct. 17, 1979

[51] Int. Cl.[3] ..... F02P 7/02

[52] U.S. Cl. ..... 123/146.5 A; 200/19 DR; 200/19 DC

[58] Field of Search ..... 123/146.5 A; 200/19 R, 200/19 DR, 19 DC

[56] References Cited

U.S. PATENT DOCUMENTS

| | | | |
|---|---|---|---|
| 1,522,909 | 1/1925 | Rice . | |
| 1,939,807 | 12/1933 | Fibish | 200/19 DR |
| 2,305,018 | 12/1942 | MacGillivray | 123/146.5 A |
| 2,605,368 | 7/1952 | Scott | 123/146.5 A |
| 3,062,928 | 11/1962 | Machado | 200/19 DR |
| 3,339,535 | 9/1967 | McClure | 123/148 |
| 3,906,920 | 9/1975 | Hemphill | 123/148 E |
| 4,011,851 | 3/1977 | Beutler | 123/146.5 A |

FOREIGN PATENT DOCUMENTS

| | | | |
|---|---|---|---|
| 2739753 | 11/1978 | Fed. Rep. of Germany | 123/146.5 A |

OTHER PUBLICATIONS

J. C. Whitney & Co., Parts and Accessories, Catalog No. 373B, p. 116.

*Primary Examiner*—Charles J. Myhre
*Assistant Examiner*—Andrew M. Dolinar
*Attorney, Agent, or Firm*—Dowrey & Cross

[57] ABSTRACT

A method and apparatus for converting simultaneously firing multi-cylinder engine ignition systems to sequential firing. The apparatus includes an adapter attachment to the circuit breaker block of a conventional ignition system, a rotor, and a distributor cap. Upon rotation of the adapter the rotor distributes the spark to the individual cylinders of the engine. Modification of the adapter allows attachment to various existing vehicles.

9 Claims, 4 Drawing Figures

METHOD AND APPARATUS FOR MODIFYING THE IGNITION SYSTEM OF MULTI-CYLINDER ENGINES

BACKGROUND OF THE INVENTION

This invention relates to ignition systems for vehicles, and more particularly to an improved form of ignition device and system for facilitating the conversion of a conventional circuit breaker system to a distributed spark system. Various types of ignition systems and devices are used today in motor vehicles with small internal combustion engines. The most common ignition system utilizes a circuit breaker block assembly which includes a pair of points which are caused to open and close on rotation of a cam in synchronism with engine rotation. These points are electrically connected to open and close the primary winding of an ignition coil. In typical circuit breaker systems, such as found in the Harley-Davidson motorcycle, a single ignition coil fires each spark plug twice during each cycle; the first spark occurs immediately before the power stroke and ignites the fuel air mixture, a second spark occurs during the exhaust stroke as a consequence of the plugs being connected in parallel. This system, or a variant thereof, is in general use in multicylinder motorcycle engines. The multi-cylinder engine has grown in importance, of course, due to its greater power and smoother operation as compared to single cylinder engines.

The present conditions of uncertainty of fuel supply combined with demand for improved performance, however, have created a need for means of improving the engine efficiency of all vehicles.

The primary disadvantage of circuit breaker ignition systems used in multi-cylinder internal combustion engines is the presence of a spark during the exhaust stroke. Under several running conditions the spark on the exhaust stroke may ignite exhaust gases in the cylinder, which produces increased back-pressure in the engine. When the back-pressure of the engine is increased the engine must utilize a proportion of its power to overcome the increased back-pressure. The increased back-pressure produces a rough running engine common in vehicles of this type. The engine efficiency is also lowered. A need has thus arisen to provide means for removing the spark during the exhaust cycle of the cylinder both for smooth running and for improving engine efficiency.

The engines used in large motor vehicles such as cars and trucks do not have the disadvantage of having spark during the exhaust cycle. In such large internal combustion engines the distribution of the spark is controlled by a distributor. To date distributed spark systems have not been used in motorcycle engines.

Large numbers of engines are presently existing that require improved ignition systems. A need has, thus, arisen for an improved ignition system having the ability of being retrofitted to engines already manufactured. All prior art modifiers have required disassembly and loss of many of the components of the conventional ignition system and long installation times.

SUMMARY OF THE INVENTION

The present invention provides an improved spark distribution apparatus for multi-cylinder internal combustion engines which can be readily substituted for a conventional circuit breaker ignition. The present apparatus includes a distributor cap adapted for attachment to the existing circuit breaker block of an ignition system and to the spark plug cables. A rotor is located within the distributor cap for distributing the spark to the cylinder which is desired to be fired and for preventing any spark from occuring in the cylinder which is in the exhaust stroke. An adapter is provided which attaches to the cam of the conventional ignition system and to the rotor. The adapter is of varying configurations dependent upon the type of ignition system to which adoption is sought.

In modifying the ignition system of an existing vehicle it is only necessary to remove the cover of the circuit breaker. The adapter is then attached to the cam of the circuit breaker and the rotor attached to the adapter. The distributor cap is then attached to cover the circuit breaker head in the position formally occupied by the cover. One wire from the coil is attached to the center contact of the distributor cap and the spark plugs are attached to the remaining terminals on the distributor cap. The advance systems of the circuit breaker ignition operate in their normal manner. The time of installation is minimal. No further modification to the ignition system is necessary and the improvement in performance of the engine is immediately apparent.

DETAILED DESCRIPTION OF THE DRAWINGS

Figure 1:
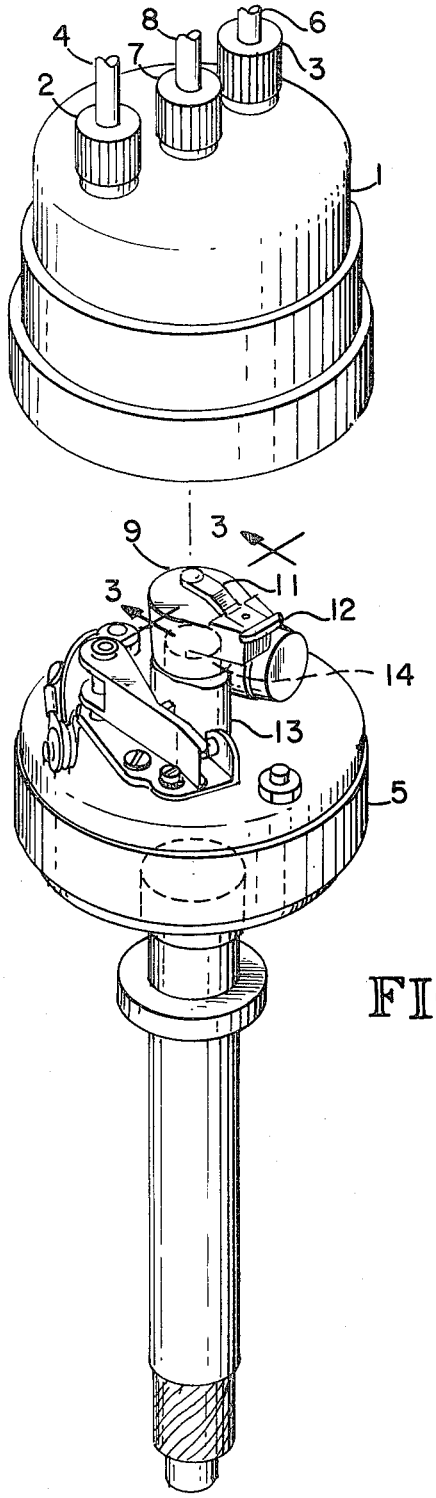
FIG. 1 is an exploded view of a circuit breaker with a first embodiment of the invention installed.

FIG. 1 is an exploded view of the device as attached to a Harley-Davidson circuit breaker head as manufactured between 1965 and 1969. The device has three major components, a distributor cap 1, rotor 9 and adapter 14. The distributor cap 1 fits in close conforming relationship to the circuit breaker head 5 replacing the cover used in conventional ignition systems. Distributor cap 1 has a central terminal 7 which is attached to the spark coil (not shown) by wire 8. Distributor cap 1 also has two terminals 2, 3, each attached to spark plugs (not shown) by wires 4, 6. Terminal 2 is displaced $17\frac{1}{2}$ degrees from a line drawn through the centers of terminals 3 and 7. This displacement allows proper timing of the spark with respect to this particular engine. The displacement of course will vary with engines having different timing requirements. Distributor cap 1 is constructed of an insulating material to provide proper isolation of high voltage. The contacts attached to terminals 2, 7 and 3 are similar in form to those used in automobile distributor caps. Distributor cap 1 may also have locking devices to prevent rotation from its proper position on circuit breaker head 5. Locking devices include set screws, notches and the like.

Rotor 9 is comprised of a spring contact 11 and switching contact 12 attached to the insulating body of the rotor 9. Spring contact 11 is so configured as to make contact with the center contact on terminal 7 of distributor cap 1 when the device is assembled. Contact spring 11 is attached to switching contact 12 both mechanically and electrically. Switching contact 12 is so dimensioned as to bridge and provide a path for electricity between the contacts attached to terminals 2 and 3 of distributor cap 1 and spring contact 11. A conventional automobile rotor has been found satisfactory in this embodiment of the invention. Circuit breaker head 5 as conventionally arranged has no provision for attachment of a distributor rotor and accordingly an adapter 14 must be provided.

Figure 3:
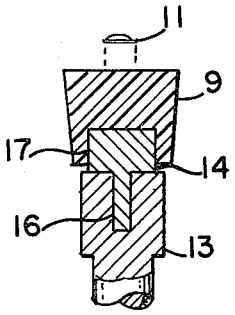
FIG. 3 is a sectional view of the FIG. 1 embodiment through lines 3—3.

FIG. 3 is a sectional drawing through line 3—3 of FIG. 1 that illustrates the method of attachment of adapter 14. Cam 13 has a rectangular hole originally intended for attachment of a tachometer cable. The body of adapter 14 provides a projection 16 on its lower surface which is inserted into the hole in cam 13. The upper surface of the body of adapter 14 is so configured as to provide an attachment surface for rotor 9. The body of adapter 14 also must be so configured as to lock rotor 9 into a position where rotation relative to cam 13 is impossible. If this condition is not maintained it will not be possible to time the engine.

Figure 2:
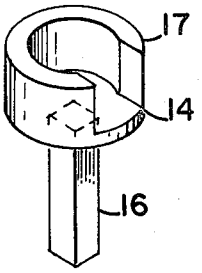
FIG. 2 is an isometric drawing of the FIG. 1 adapter.

FIG. 2 shows adapter 14 as configured for 1965 through 1969 Harley-Davidson motorcycles in greater detail. The lower surface of the body of adapter 14 comprises a projection 16 for insertion into the hole in cam 13. The upper surface 17 of the body of adapter 14 provides a circular area with a slot for adaption and locking to the rotor 9. The surface of projection 16 must be machined to within one-thousandth of an inch of the profile of cam 13 to provide a press fit. It is essential that the press fit to cam 13 be sufficiently tight so that adapter will not loosen from cam 13 during operation.

Figure 4:
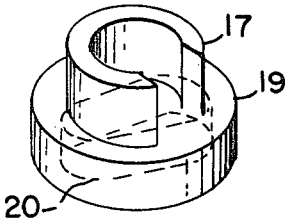
FIG. 4 is a second embodiment of the adapter.

FIG. 4 illustrates a second embodiment of adapter 14. The adapter of FIG. 4 is configured for Harley-Davidson motorcycles manufactured between 1936 and 1946. The circuit breaker cam 13 of these engines does not provide a rectangular hole. Accordingly, an alternative means of attachment to cam 13 is provided. The upper portion of the body of adapter 14 is similar to that shown in the FIG. 2 configuration. The means of attachment to cam 13 is provided by lower surface 19 of the body of adapter 14. Lower surface 19 provides a cavity 20 machined to conform to the shape of cam 13. It is essential that cavity 20 match the configuration of cam 13 to within one-thousandth of an inch to provide a satisfactory press fit. If the press fit is not satisfactory adapter 14 will loosen under the severe vibrational conditions of use. Cavity 20 must also be of such depth as to prevent interference with the operation of the breaker points. It has been found satisfactory in this embodiment to provide a cavity having a depth of approximately one-eighth inch.

To install the device the user removes the cover of the conventional circuit breaker. Adapter 14 is press fit attached to cam 13. Rotor 9 is then locked onto adapter 14. Distributor cap 1 then is attached to circuit breaker head 5 in the position formally occupied by the cover. A wire 8 from the coil is attached to the central terminal of distributor cap 1. Wires 4 and 6 formerly attached to the coil are attached to terminals 2 and 3. This completes the installation and the engine is operated as before. The invention is usable with differing brands and models of engines. The lower surface of adapter 14 may be modified to fit any existing cam. Under some circumstances it is necessary to alter the angle between terminals 2 and 3 of distributor cap 1 to conform with engines having cylinders set at differing angles. These modifications are possible by any person skilled in the art and do not alter the operation of the device. The device allows conventional operation of the spark advance systems of the engine and does not hinder replacement of points or capacitor.

Although the present invention has been described with reference to a particular embodiment thereof, it will be understood by those skilled in the art that numerous modifications may be made without departing from the scope of the invention. Accordingly, all modifications and equivalents may be resorted to which fall within the scope of the invention as claimed.

What is claimed is:

1. In an ignition system for a multi-cylinder engine having a plurality of cylinders with associated spark plugs and at least power and exhaust strokes associated with each cylinder, a single ignition coil and a circuit breaker block with a pair of points which open and close on rotation of a cam driven by a crankshaft of the engine, causing each spark plug to fire immediately before the power stroke and during the exhaust stroke of its associated cylinder, the improvement comprising means for converting said ignition system to a distributed spark ignition system including:

a distributor cap overlying the circuit breaker block with a plurality of electrical contacts attached to the coil and spark plugs, and a rotor within said distributor cap for distributing electricity between the contacts of said distributor cap in timed sequence, and adapter means for adapting said cam for attachment to said rotor, whereby each spark plug will be fired immediately prior to the power stroke of its associated cylinder only.

2. The assembly of claim 1 wherein said adapter means comprises;

a body, rotor attachment means on the top of said body for forming a driving connection with a said rotor, and cam attachment means on the bottom of said body for forming a driving connection with said cam.

3. The assembly of claim 2 wherein said cam includes a cavity and said cam attachment means of said adapter means comprises a projection that is insertable with a press fit into the cavity on said cam.

4. The circuit breaker of claim 2 wherein said cam attachment means of said adapter means comprises a cavity dimensioned to conform to the outside dimension of said cam and to provide a press fit to said cam.

5. A method for converting a single coil ignition system having a circuit breaker block with a pair of points which open and close on rotation of a cam, causing each spark plug associated with a cylinder of a multi-cylinder engine having at least power and exhaust strokes associated with each cylinder to fire immediately before the power stroke and during the exhaust stroke of each cylinder to a distributed spark ignition system, wherein each spark plug is fired in timed sequence immediately prior to the power stroke of the associated cylinder only, comprising:

mounting a rotor on the cam of the circuit breaker block, rotating the rotor in synchronism with the cam of the circuit breaker block, and distributing the spark to the cylinders in timed sequence immediately prior to the power stroke only.

6. An adapter apparatus for use in converting a single coil ignition system having a circuit breaker block with a pair of points which open and close on rotation of a cam causing each spark plug associated with a cylinder of multi-cylinder engine having at least power and exhaust strokes associated with each cylinder to fire immediately before the power stroke and during the exhaust stroke of each cylinder to a distributed spark ignition system, wherein each spark plug is fired in timed sequence immediately prior to the power stroke of the associated cylinder only, comprising:

a body, rotor attachment means on the upper surface of said body adapted for attaching a spark distributor rotor to said body, and cam attachment means on the lower surface of said body for directly attaching the cam of said ignition system to said body.

7. The adapter apparatus of claim 6 wherein said cam includes a cavity and said cam attachment means comprises a projection insertable with a press fit into the cavity on said cam.

8. The adapter apparatus of claim 6 wherein said cam attachment means comprises a cavity the interior of which conforms to the outer dimension of said cam and provides a press fit to said cam.

9. The adapter apparatus of claim 6 wherein the cam has a tachometer cable attachment hole and wherein said cam attachment means comprises a projection insertable into the tachometer cable attachment hole.

* * * * *